US012605644B2

(12) United States Patent
Eskenas

(10) Patent No.: US 12,605,644 B2
(45) Date of Patent: Apr. 21, 2026

(54) MAGNETIC PLAYING CARD BUILDING TOY

(71) Applicant: Shari Eskenas, Simi Valley, CA (US)

(72) Inventor: Shari Eskenas, Simi Valley, CA (US)

( * ) Notice: Subject to any disclaimer, the term of this patent is extended or adjusted under 35 U.S.C. 154(b) by 226 days.

(21) Appl. No.: 18/644,401

(22) Filed: Apr. 24, 2024

(65) Prior Publication Data

US 2025/0196017 A1 Jun. 19, 2025

Related U.S. Application Data

(60) Provisional application No. 63/611,323, filed on Dec. 18, 2023.

(51) Int. Cl.
*A63H 33/04* (2006.01)
*A63H 33/26* (2006.01)

(52) U.S. Cl.
CPC ..... *A63H 33/046* (2013.01)

(58) Field of Classification Search
CPC ..... A63H 33/04; A63H 33/046; A63H 33/06; A63H 33/26; A63F 1/02
USPC ..... 446/85, 92, 108, 129, 137
See application file for complete search history.

(56) References Cited

U.S. PATENT DOCUMENTS 5,021,021 A * 6/1991 Ballard ..... A63H 33/046 446/92
6,431,936 B1 * 8/2002 Kiribuchi ..... A63H 33/046 446/92
7,160,170 B2 * 1/2007 Yoon ..... A63H 33/046 273/156
8,187,006 B2 * 5/2012 Rudisill ..... H01R 11/30 362/249.06
8,458,863 B2 * 6/2013 Hunts ..... H01F 7/0242 446/92
9,574,355 B2 * 2/2017 Meyer ..... A47G 1/00
9,636,600 B2 * 5/2017 Rudisill ..... A63H 33/046
9,713,777 B2 * 7/2017 Peterson ..... B29C 65/56
10,258,896 B2 * 4/2019 Ornstein ..... A63H 33/06
10,857,475 B2 * 12/2020 Moskowitz ..... A63H 33/108
10,918,963 B2 * 2/2021 Ornstein ..... A63H 33/06
11,642,604 B1 * 5/2023 Xie ..... A63H 33/046 446/92
11,833,443 B2 * 12/2023 Yamaai ..... A63H 29/22
12,145,078 B2 * 11/2024 Xie ..... A63H 33/26
(Continued)

*Primary Examiner* — Alexander R Niconovich

(57) ABSTRACT

A magnetic playing card includes a substrate disposed between a playing-card front face and a playing-card back face. The substrate includes edge magnet groups disposed at edges of the substrate and interior magnet groups disposed at an interior of the substrate, wherein each magnet group is defined by a pair of apertures holding composite magnets. Each composite magnet comprises first and second sub-magnets fixed together in opposite polar directions. For edge magnet groups, the sub-magnets are configured to present both a north pole and a south pole toward the corresponding edge. For interior magnet groups, the sub-magnets are configured to present both a north pole and a south pole toward the top surface. The polarity architecture permits magnetic coupling between any edge magnet group or interior magnet group of a first magnetic playing card and any edge magnet group or interior magnet group of a second magnetic playing card, in either face-up orientation.

8 Claims, 17 Drawing Sheets

(56) References Cited

U.S. PATENT DOCUMENTS

| | | | | |
|---|---|---|---|---|
| 2014/0256210 | A1* | 9/2014 | Johnson | A63H 33/046<br>446/108 |
| 2014/0302741 | A1* | 10/2014 | Whittaker | A63H 33/046<br>446/92 |
| 2015/0072587 | A1* | 3/2015 | Ornstein | A63H 33/046<br>446/92 |
| 2015/0231521 | A1* | 8/2015 | Peterson | B29C 65/56<br>446/92 |
| 2020/0246715 | A1* | 8/2020 | Bensussan | A63H 33/10 |
| 2020/0353375 | A1* | 11/2020 | Kogure | A63H 33/046 |
| 2022/0297021 | A1* | 9/2022 | Liu | A63H 33/22 |
| 2025/0083064 | A1* | 3/2025 | Hindmarsh | A63H 33/046 |

* cited by examiner

MAGNETIC PLAYING CARD BUILDING TOY

CROSS-REFERENCE TO RELATED APPLICATIONS

This application claims benefit of priority with U.S. Provisional Application Ser. No. 63/611,323 filed Dec. 18, 2023; the entire contents of which are hereby incorporated by reference.

BACKGROUND

Field of the Invention

This invention relates to magnetic playing cards; more particularly, to magnetic playing cards with a plurality of edge magnet groups and a plurality of interior magnet groups for universal magnetic coupling with a secondary magnetic playing card.

Description of the Related Art

Toys involving building and construction are used frequently by children to promote problem-solving skills, enhance fine motor skills, and foster creativity and imagination. Conventional building toys involving magnetic couplings have been taught including Kiribuchi (U.S. Pat. No. 6,431,936), Rudisill et al. (U.S. Pat. No. 9,636,600) and Peterson (US Pub. No. 2015/0231521) which all follow similar structure and magnet configurations for coupling tile sides together. However, the arrangement and configuration of magnetic coupling is limited and certain structures are not possible.

Additionally, use of conventional playing cards to build structures can be commonly done by children and adults but requires particular card stacking experience that can be particularly difficult for some. There is a need for playing cards that allows for quick and easy construction of structures.

SUMMARY

The disclosure concerns a magnetic playing card configured to magnetically couple to a secondary magnetic playing card. The magnetic playing card comprises a front side comprising a playing card front face, a back side comprising a playing card back face, and a substrate disposed between the front side and the back side. The substrate comprises a top surface, a bottom surface opposite the top surface, and a plurality of edges coupled to each of the top surface and the bottom surface. The plurality of edges includes a first major side, a second major side opposite the first major side, a first minor side, and a second minor side opposite the first minor side. The plurality of edges surrounds a substrate interior, the substrate interior comprising a center of the substrate. The substrate further comprises a plurality of magnet groups. The plurality of magnet groups comprises a plurality of edge magnet groups and a plurality of interior magnet groups. The plurality of edge magnet groups is disposed at the plurality of edges, wherein each of the plurality of edges comprises one of the plurality of edge magnet groups. The plurality of interior magnet groups is disposed at the substrate interior. Each of the plurality of edge magnet groups and the plurality of interior magnet groups is configured to magnetically couple to any edge magnet group or interior magnet group of the secondary magnetic playing card.

BRIEF DESCRIPTION OF THE DRAWINGS

Other features, combinations, and embodiments will be appreciated by one having the ordinary level of skill in the art upon a thorough review of the following details and descriptions, particularly when reviewed in conjunction with the drawings, wherein.

DETAILED DESCRIPTION

Figure 1:
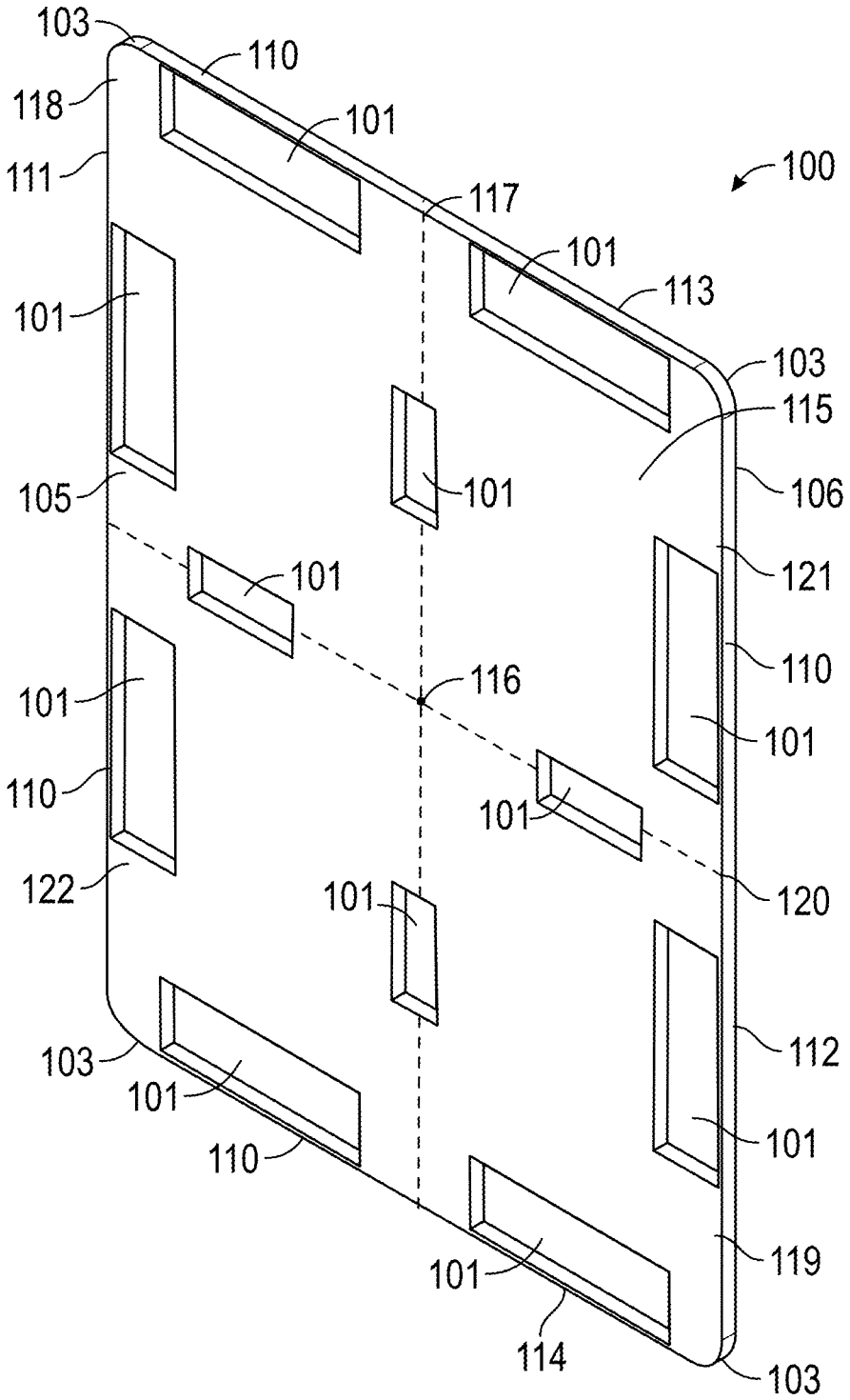
FIG. 1 shows a perspective view of a substrate in accordance with an illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

For purposes herein, the term "playing card front face" means a front side of a conventional playing card having a suit and a rank. The suit comprises one of a spade, heart, club, or diamond. The rank comprises one of a 2, 3, 4, 5, 6, 7, 8, 9, 10, Jack, Queen, King, or Ace.

The term "playing card back face" means a side opposite the playing card front side shared by all cards in a standard 52-card deck.

The term "about" means having a tolerance of 5%.

The term "pole" in "north pole" and "south pole" means the two ends or regions in a magnet where magnetic forces are the strongest.

The term "secondary magnetic playing card" means a playing card having a same structure as the magnetic playing card disclosed herein. Secondary magnetic playing card is used herein to illustrate the interaction between two magnetic playing cards.

The term "group" means a collection of two or more magnets.

The term "polar direction" means a linear representation from a magnet's north pole to the south pole, indicating the direction of the magnetic field lines.

The term "polarity order" means arrangement of a magnet's magnetic poles where one end is the north pole and the opposite end is the south pole. The polarity order dictates the polar direction of the magnetic field lines which emerge from the north pole and re-enter at the south pole, establishing the magnet's field orientation.

The term "uniform polarity alignment" means each magnet edge group and/or interior group features a consistent magnet polarity order from the leftmost magnet to the rightmost magnet.

The term "leftmost magnet" means a magnet located on the left when the magnet group is observed from a front view orientation with the two magnets positioned side-by-side in horizontal alignment.

The term "rightmost magnet" means a magnet located on the right when the magnet group is observed from a front view orientation with the two magnets positioned side-by-side in horizontal alignment.

The term "sub-magnet" means an individual and distinct magnet such that a magnet comprising a first sub-magnet and a second sub-magnet comprises two individual magnets coupled together.

The term "planar structure" means a magnet whose physical form is characterized as having a flat, thin shape with a significant extent in two dimensions to form a top face and a bottom face of the planar structure, and a lesser extent in the third dimension to form a thickness of the planar structure.

Unless explicitly defined herein, terms are to be construed in accordance with the plain and ordinary meaning as would be appreciated by one having skill in the art.

General Description of Embodiments

In one general embodiment, a magnetic playing card configured to magnetically couple to a secondary magnetic playing card is disclosed. The magnetic playing card comprises a front side comprising a playing card front face, a back side comprising a playing card back face, and a substrate disposed between the front side and the back side. The substrate comprises a top surface and a bottom surface opposite the top surface, and a plurality of edges coupled to each of the top surface and the bottom surface. The plurality of edges includes a first major side, a second major side opposite the first major side, a first minor side, and a second minor side opposite the first minor side. A substrate interior is surrounded by the plurality of edges, the substrate interior comprising a center of the substrate. The substrate further comprises a plurality of magnet groups comprising a plurality of edge magnet groups and a plurality of interior magnet groups. The plurality of edge magnet groups is disposed at the plurality of edges, wherein each of the plurality of edges comprises one of the plurality of edge magnet groups. The plurality of interior magnet groups is disposed at the substrate interior, wherein each of the plurality of edge magnet groups and the plurality of interior magnet groups is configured to magnetically couple to any edge magnet group or interior magnet group of the secondary magnetic playing card.

In some embodiments, each magnet of the plurality of edge magnet groups may comprise an edge polar direction, and each magnet of the plurality of interior magnet groups may comprise an interior polar direction, wherein the edge polar direction extends parallel to the top surface, and the interior polar direction extends orthogonal to the top surface.

In some embodiments, each magnet of the plurality of edge magnet groups may comprise an edge polar direction, and each magnet of the plurality of interior magnet groups may comprise an interior polar direction, wherein the edge polar direction extends orthogonal to the top surface, and the interior polar direction extends orthogonal to the top surface.

In some embodiments, the plurality of magnet groups may be embedded within the substrate.

In some embodiments, the substrate may further comprise a plurality of apertures, wherein the plurality of magnet groups is disposed within the plurality of apertures. The magnetic playing card may further comprise a top flat plate coupled to the top surface and a bottom flat plate coupled to the bottom surface, wherein the plurality of magnet groups is disposed between the top flat plate and the bottom flat plate. The playing card front face may be disposed on the top flat plate and the playing card back face may be disposed on the bottom flat plate.

In some embodiments, the first major side and the second major side may each comprise a length of about 3.5 inches, and the first minor side and the second minor side may each comprise a length of about 2.5 inches.

In some embodiments, the substrate may further comprise a longitudinal centerline extending from the first minor side to the second minor side, wherein at least one of the plurality of interior magnet groups is disposed on the longitudinal centerline. The substrate may further comprise a lateral centerline extending from the first major side to the second major side, the lateral centerline being perpendicular to the longitudinal centerline, wherein at least one of the plurality of interior magnet groups is disposed on the lateral centerline. The longitudinal centerline and the lateral centerline may each extend through the center of the substrate.

In some embodiments, the substrate may further comprise rounded corners.

In some embodiments, each of the plurality of magnet groups may further comprise a plurality of magnets, wherein the plurality of magnets comprises an alternating polarity order.

In some embodiments, wherein each of the plurality of magnet groups may comprise a first magnet and a second magnet, the first magnet having a first polarity order and the second magnet having a second polarity order, wherein the first magnet polarity order is opposite the second magnet polarity order.

In some embodiments, each of the plurality of magnet groups may comprise a leftmost magnet and a rightmost magnet, wherein the first magnet is the leftmost magnet and the second magnet is the rightmost magnet. The first magnet in each of the plurality of magnet groups may comprise a same polarity order, and further wherein the second magnet in each of the plurality of magnet groups may comprise a same polarity order.

In some embodiments, wherein the plurality of magnet groups may comprise a uniform polarity alignment.

In some embodiments, each magnet in the plurality of edge magnet groups may comprise an edge north pole and an edge south pole, the edge north pole and the edge south pole each facing a nearest edge of the plurality of edges. Each magnet of the plurality of interior magnet groups may comprise an interior north pole and an interior south pole, wherein the interior north pole faces at least one of the top surface and the bottom surface, and wherein the interior south pole faces at least one of the top surface and the bottom surface.

In some embodiments, each magnet in the plurality of edge magnet groups and the plurality of interior magnet groups may comprise a first sub-magnet and a second sub-magnet, the first sub-magnet being individual and distinct from the second sub-magnet. The first sub-magnet may comprise a polarity order opposite the second sub-magnet. A polar direction of the first sub-magnet may comprise a parallel and opposite orientation with a polar direction of the second sub-magnet.

In some embodiments, each magnet of the plurality of magnet groups may comprise a planar structure.

In some embodiments, each magnet in the plurality of interior magnet groups may comprise a first sub-magnet and a second sub-magnet, the first sub-magnet being individual and distinct from the second sub-magnet. The first sub-magnet may comprise a polarity order opposite the second sub-magnet. A polar direction of the first sub-magnet may comprise a parallel and opposite orientation with a polar direction of the second sub-magnet.

In another general embodiment, a substrate for a magnetic playing card is disclosed. The substrate comprises a top surface and a bottom surface opposite the top surface, and a plurality of edges coupled to each of the top surface and the bottom surface. The plurality of edges includes a first major side, a second major side opposite the first major side, a first minor side, and a second minor side opposite the first minor side. A substrate interior is surrounded by the plurality of edges, the substrate interior comprising a center of the substrate. The substrate further comprises a plurality of magnet groups comprising a plurality of edge magnet groups and a plurality of interior magnet groups. The plurality of edge magnet groups is disposed at the plurality of edges, wherein each of the plurality of edges comprises one of the plurality of edge magnet groups. The plurality of interior magnet groups is disposed at the substrate interior, wherein each of the plurality of edge magnet groups and the plurality of interior magnet groups is configured to magnetically couple to any edge magnet group or interior magnet group of the secondary magnetic playing card.

In some embodiments, each magnet of the plurality of edge magnet groups may comprise an edge polar direction, and each magnet of the plurality of interior magnet groups may comprise an interior polar direction, wherein the edge polar direction extends parallel to the top surface, and the interior polar direction extends orthogonal to the top surface.

In some embodiments, each magnet of the plurality of edge magnet groups may comprise an edge polar direction, and each magnet of the plurality of interior magnet groups may comprise an interior polar direction, wherein the edge polar direction extends orthogonal to the top surface, and the interior polar direction extends orthogonal to the top surface.

In some embodiments, the plurality of magnet groups may be embedded within the substrate.

In some embodiments, the substrate may further comprise a plurality of apertures, wherein the plurality of magnet groups is disposed within the plurality of apertures.

In some embodiments, the first major side and the second major side may each comprise a length of about 3.5 inches, and the first minor side and the second minor side may each comprise a length of about 2.5 inches.

In some embodiments, the substrate may further comprise a longitudinal centerline extending from the first minor side to the second minor side, wherein at least one of the plurality of interior magnet groups is disposed on the longitudinal centerline. The substrate may further comprise a lateral centerline extending from the first major side to the second major side, the lateral centerline being perpendicular to the longitudinal centerline, wherein at least one of the plurality of interior magnet groups is disposed on the lateral centerline. The longitudinal centerline and the lateral centerline may each extend through the center of the substrate.

In some embodiments, the substrate may further comprise rounded corners.

In some embodiments, each of the plurality of magnet groups may further comprise a plurality of magnets, wherein the plurality of magnets comprises an alternating polarity order.

In some embodiments, wherein each of the plurality of magnet groups may comprise a first magnet and a second magnet, the first magnet having a first polarity order and the second magnet having a second polarity order, wherein the first magnet polarity order is opposite the second magnet polarity order.

In some embodiments, each of the plurality of magnet groups may comprise a leftmost magnet and a rightmost magnet, wherein the first magnet is the leftmost magnet and the second magnet is the rightmost magnet. The first magnet in each of the plurality of magnet groups may comprise a same polarity order, and further wherein the second magnet in each of the plurality of magnet groups may comprise a same polarity order.

In some embodiments, wherein the plurality of magnet groups may comprise a uniform polarity alignment.

In some embodiments, each magnet in the plurality of edge magnet groups may comprise an edge north pole and an edge south pole, the edge north pole and the edge south pole each facing a nearest edge of the plurality of edges. Each magnet of the plurality of interior magnet groups may comprise an interior north pole and an interior south pole, wherein the interior north pole faces at least one of the top surface and the bottom surface, and wherein the interior south pole faces at least one of the top surface and the bottom surface.

In some embodiments, each magnet in the plurality of edge magnet groups and the plurality of interior magnet groups may comprise a first sub-magnet and a second sub-magnet, the first sub-magnet being individual and distinct from the second sub-magnet. The first sub-magnet may comprise a polarity order opposite the second sub-magnet. A polar direction of the first sub-magnet may comprise a parallel and opposite orientation with a polar direction of the second sub-magnet.

In some embodiments, each magnet of the plurality of magnet groups may comprise a planar structure.

In some embodiments, each magnet in the plurality of interior magnet groups may comprise a first sub-magnet and a second sub-magnet, the first sub-magnet being individual and distinct from the second sub-magnet. The first sub-magnet may comprise a polarity order opposite the second sub-magnet. A polar direction of the first sub-magnet may comprise a parallel and opposite orientation with a polar direction of the second sub-magnet.

Each of the components of the magnetic playing card and related substrate described herein may be manufactured and/or assembled in accordance with the conventional knowledge and level of a person having skill in the art.

While various details, features, and combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

Illustrated Embodiments

Now turning to the drawings, FIG. 1 shows a perspective view of a substrate (100) in accordance with an illustrated embodiment. The substrate comprises a top surface (105) and a bottom surface (106) with a plurality of apertures (101) extending from the top surface to the bottom surface. The substrate further comprises a plurality of edges (110) including a first major side (111), a second major side (112) opposite the first major side, a first minor side (113), and a second minor side (114) opposite the first minor side. Disposed within the plurality of edges is a substrate interior (115) that comprises a center (116) of the substrate. A longitudinal centerline (117) extends from the first minor side to the second minor side. A lateral centerline (120) extends from the first major side to the second major side and intersects with the longitudinal centerline. As shown, both the longitudinal and lateral centerlines pass through the center of the substrate. The longitudinal centerline divides the substrate into a first longitudinal half (118) and a second longitudinal half (119). Additionally, the lateral centerline divides the substrate into a first lateral half (121) and a second lateral half (122).

The substrate (100) is configured to be disposed within a magnetic playing card to provide a unique means of magnetic coupling with a secondary magnetic playing card. The plurality of apertures (101) is configured to hold a plurality of magnets in a particular arrangement such that the magnetic playing card is able to magnetically couple any of its plurality of edges, longitudinal centerline, or lateral centerline to one of a plurality of edges, a longitudinal centerline, or lateral centerline of the secondary magnetic playing card. The plurality of apertures includes a group of apertures disposed at each of the plurality of edges, the longitudinal centerline, and the lateral centerline. As shown, each group of apertures is shown as a pair. Other even numbered groups can also be utilized including four or six. The substrate further comprises rounded corners to match the structure and shape of a conventional playing card.

Figure 2:
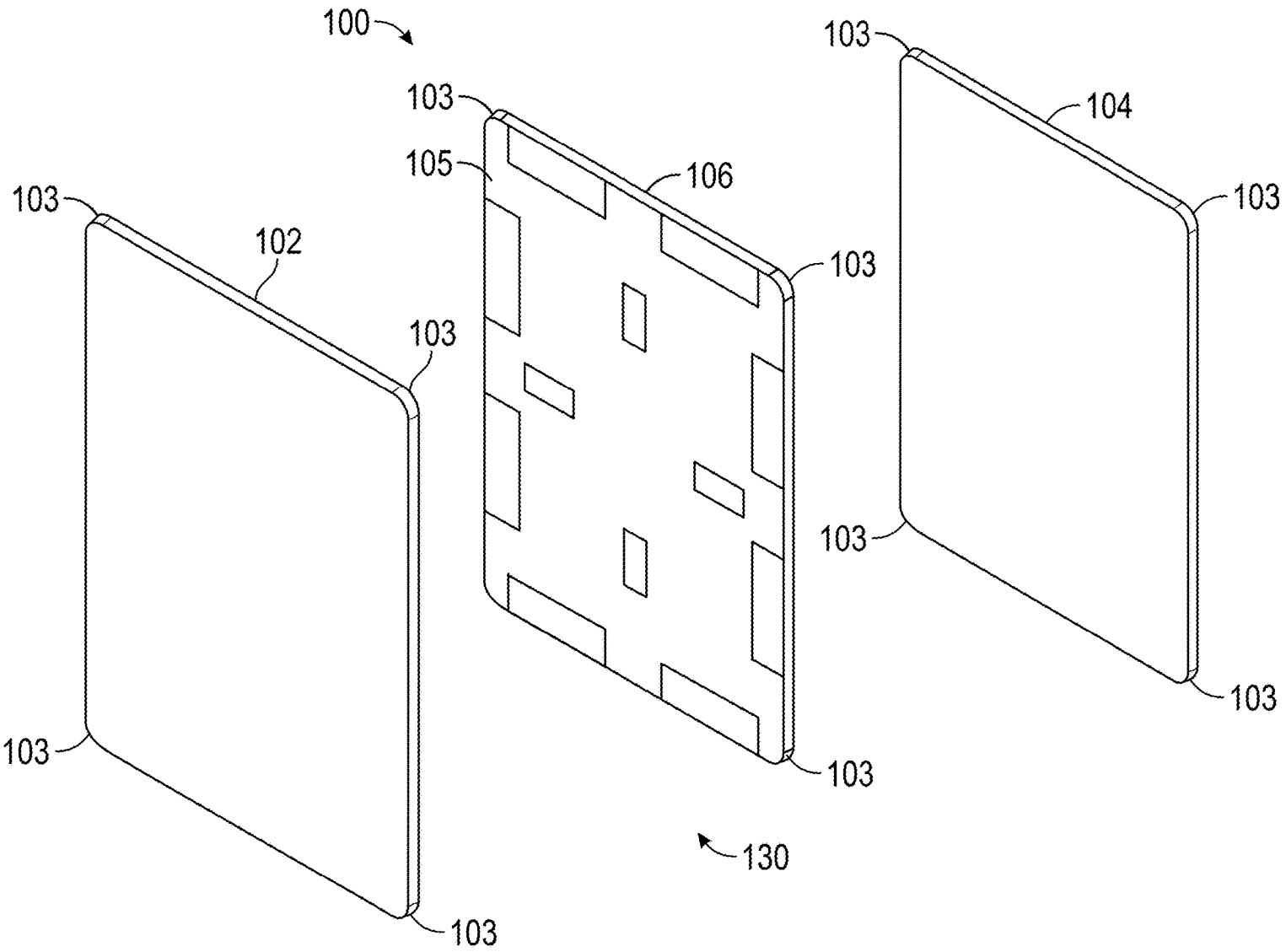
FIG. 2 shows a perspective view of the substrate with a top flat plate and a bottom flat plate in accordance with an illustrated embodiment.

FIG. 2 shows a perspective view of the substrate (100) with a top flat plate (102) and a bottom flat plate (104) in accordance with an illustrated embodiment. The substrate comprises a top surface (105) and a bottom surface (106) opposite the top surface. A plurality of magnet groups (130) is disposed within the substrate. As illustrated, one means of encapsulating the plurality of magnet groups comprises the top flat plate coupling to the top surface and the bottom flat plate coupling to the bottom surface. Each of the substrate, the top flat plate, and the bottom flat plate comprises rounded corners (103) to match the shape and structure of a conventional playing card. A playing card front surface can be disposed on the top flat plate opposite the substrate for external viewing. Likewise, a playing card back surface can be disposed on the bottom flat plate opposite the substrate for external viewing. Other means of encapsulating the plurality of magnet groups within the substrate can also be utilized as can be appreciated by one having skill in the art. Other examples may include embedding the plurality of magnet groups within an integral substrate having the desired magnet configuration.

Figure 3:
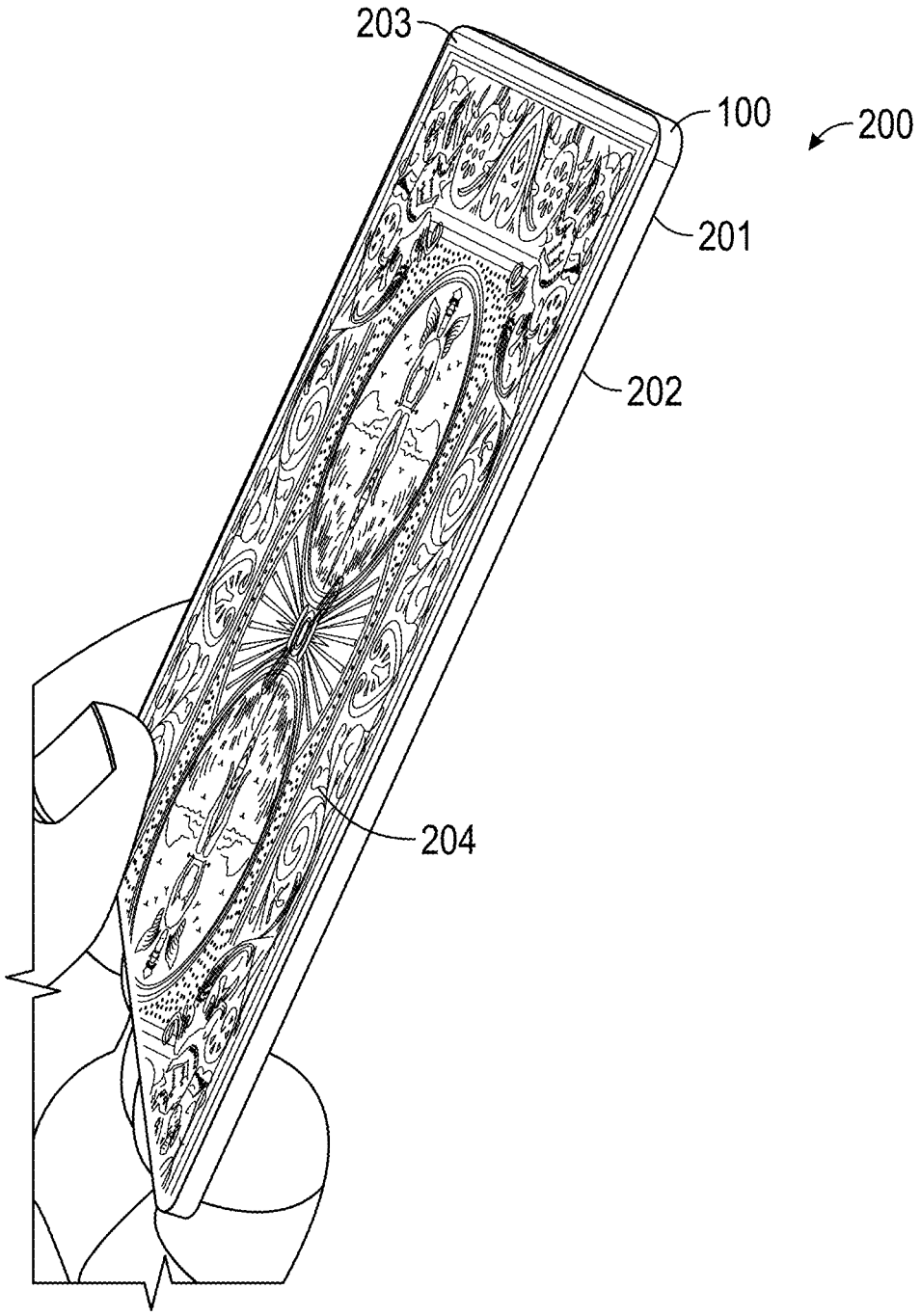
FIG. 3 shows a side view of a magnetic playing card in accordance with an illustrated embodiment.
Figure 4A:
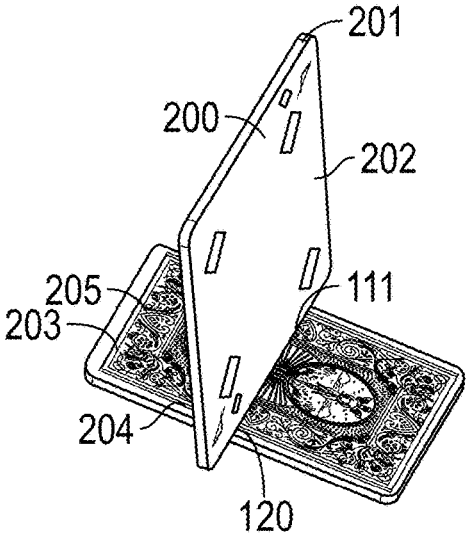
FIG. 4A shows a major side of the magnetic playing card magnetically coupled to a lateral centerline of a secondary magnetic playing card in accordance with an illustrated embodiment.
Figure 4B:
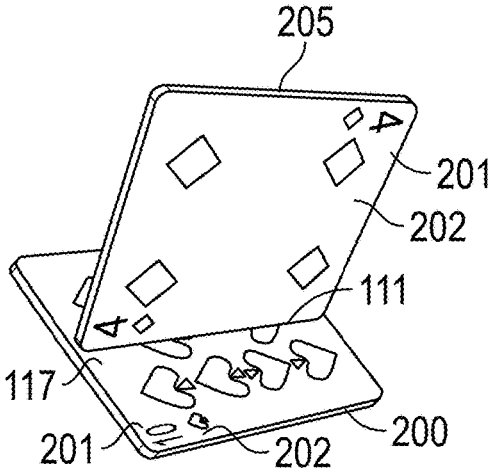
FIG. 4B shows the major side of the magnetic playing card magnetically coupled to a longitudinal centerline of the secondary magnetic playing card in accordance with an illustrated embodiment.
Figure 4C:
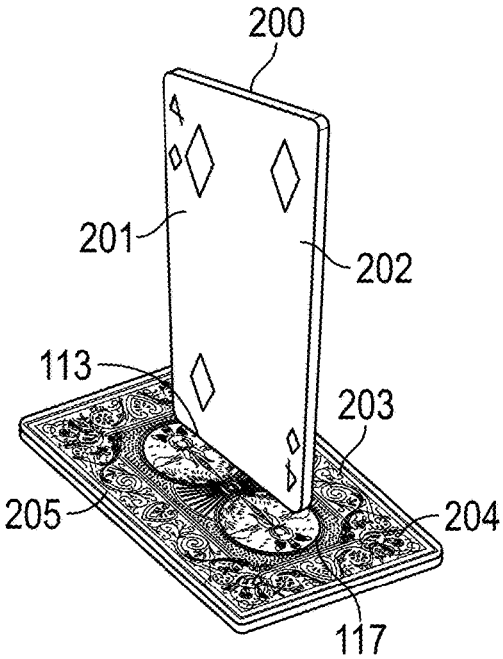
FIG. 4C shows a minor side of the magnetic playing card magnetically coupled to the longitudinal centerline of the secondary magnetic playing card in accordance with an illustrated embodiment.
Figure 4D:
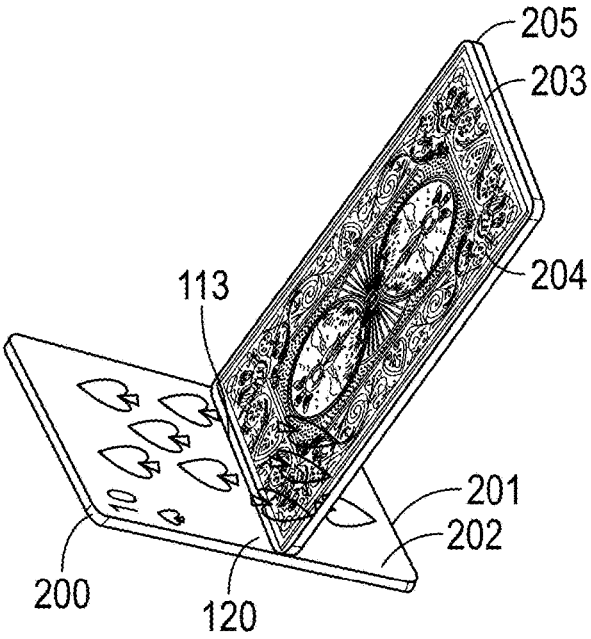
FIG. 4D shows the minor side of the magnetic playing card magnetically coupled to the lateral centerline of the secondary magnetic playing card in accordance with an illustrated embodiment.
Figure 5B:
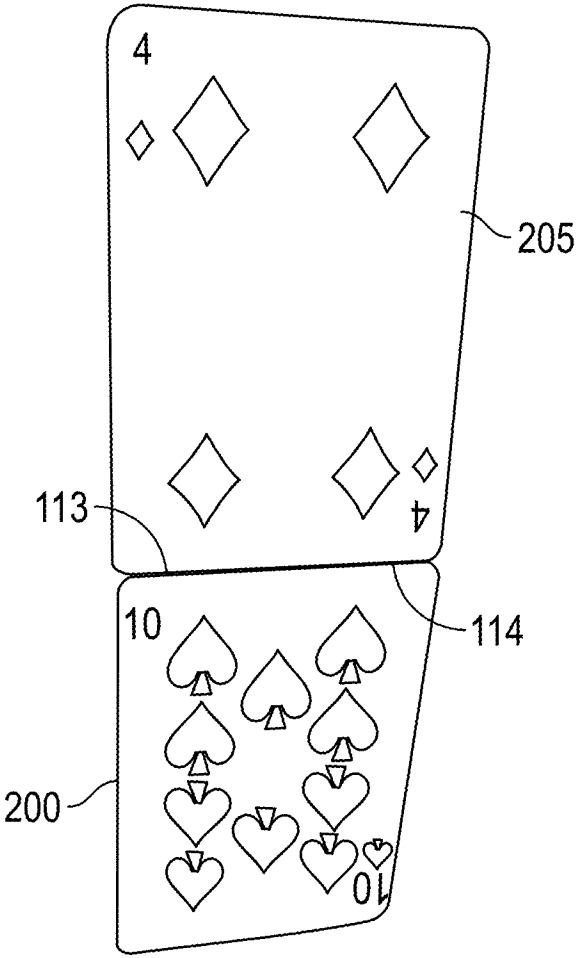
FIG. 5B shows the minor side of the magnetic playing card magnetically coupled to a minor side of the secondary magnetic playing card in accordance with an illustrated embodiment.
Figure 5A:
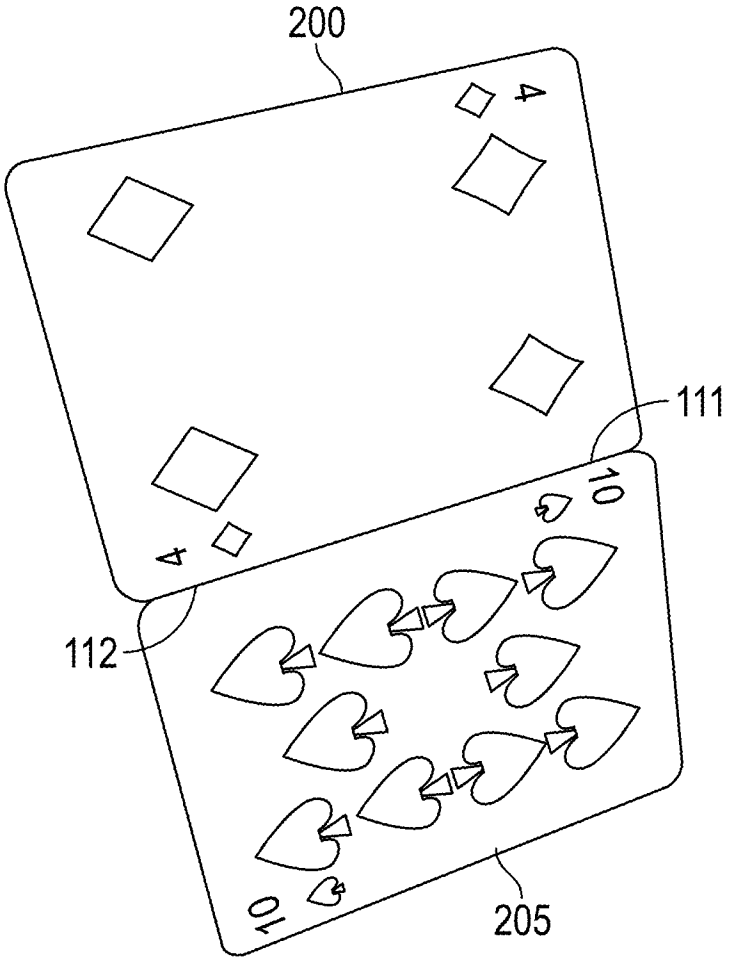
FIG. 5A shows the major side of the magnetic playing card magnetically coupled to a major side of the secondary magnetic playing card in accordance with an illustrated embodiment.

FIG. 3 shows a side view of a magnetic playing card (200) in accordance with an illustrated embodiment. The magnetic playing card comprises a substrate (100) disposed between a front side (201) and a back side (203) of the magnetic playing card. Disposed on the front side is a playing card front face (202) and disposed on the back side is a playing card back face (204). Both the playing card front face and back face can be applied to the substrate in a myriad of ways including printing, adhesives, or the like.

FIGS. 4A-5B show alternative configurations of a magnetic playing card (200) magnetically coupled to a secondary magnetic playing card (205). With the magnetic playing card and the secondary magnetic playing card both comprising a substrate with a plurality of magnet groups as disclosed herein, any one of a major side (111; 112), a minor side (113; 114), a longitudinal centerline (117), or a lateral centerline (120) of the magnetic playing card can magnetically couple with any one of a major side, a minor side, a longitudinal centerline, or a lateral centerline of the secondary magnetic playing card. Additionally, the magnetic playing card can couple at either orientation relative to the secondary magnetic playing card such that a front side having a playing card front face or a back side having a playing card back face can face either direction.

Figure 6:
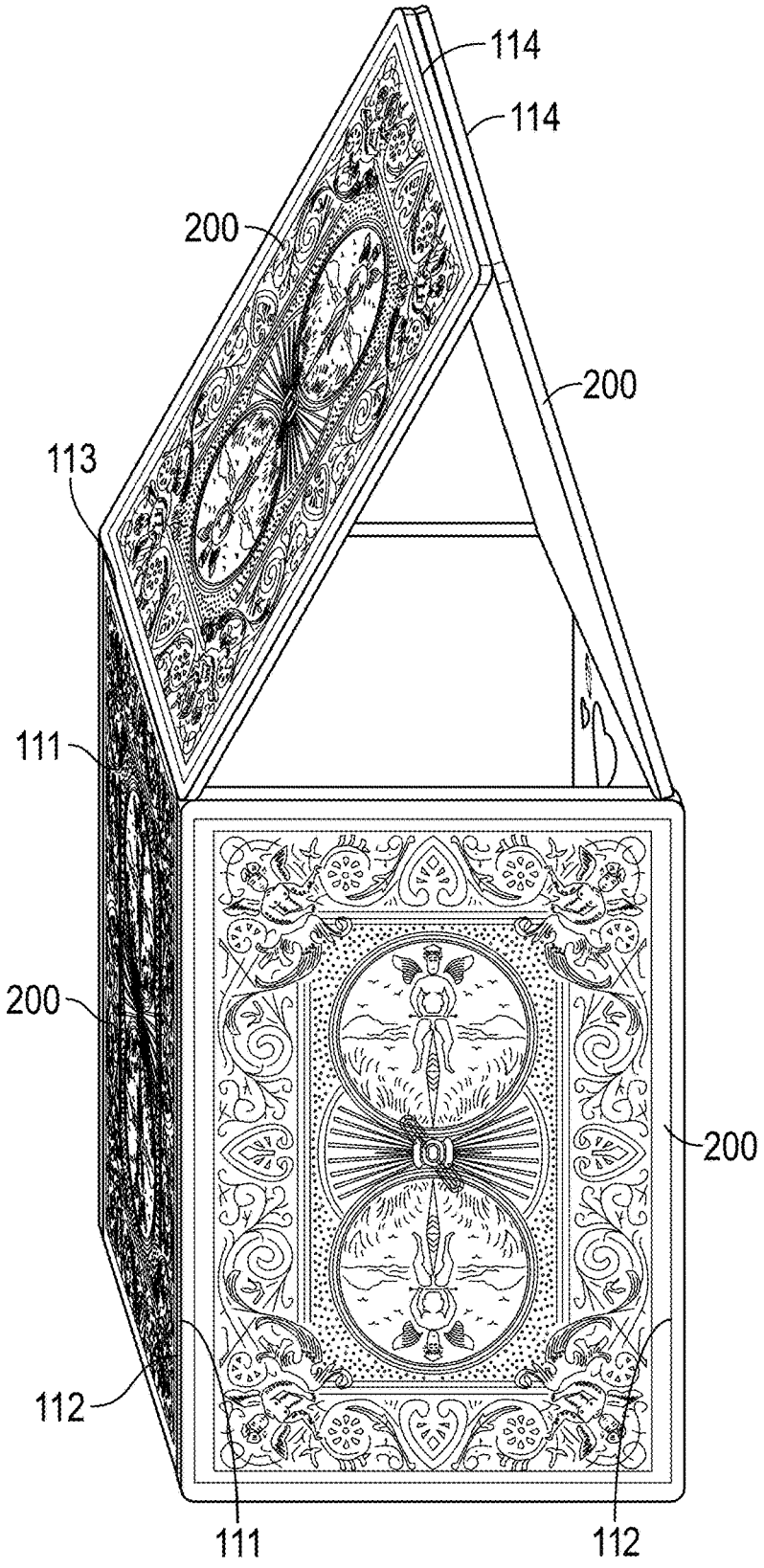
FIG. 6 shows a perspective view of a structure formed by a plurality of magnetic playing cards according to an illustrated embodiment.

FIG. 6 shows a perspective view of a structure formed by a plurality of magnetic playing cards (200) according to an illustrated embodiment. The structure can be characterized as a house having a structural integrity improved by magnetic coupling of the magnetic playing cards. A base of the house comprises four magnetic playing cards magnetically coupled to each other at respective major sides (111; 112). A roof comprises two magnetic playing cards each coupled to a minor side (113; 114) of one of the base magnetic playing cards, the two roof magnetic playing cards further coupled to each other at an opposite minor side to form an angled roof formation above the base.

Figure 7A:
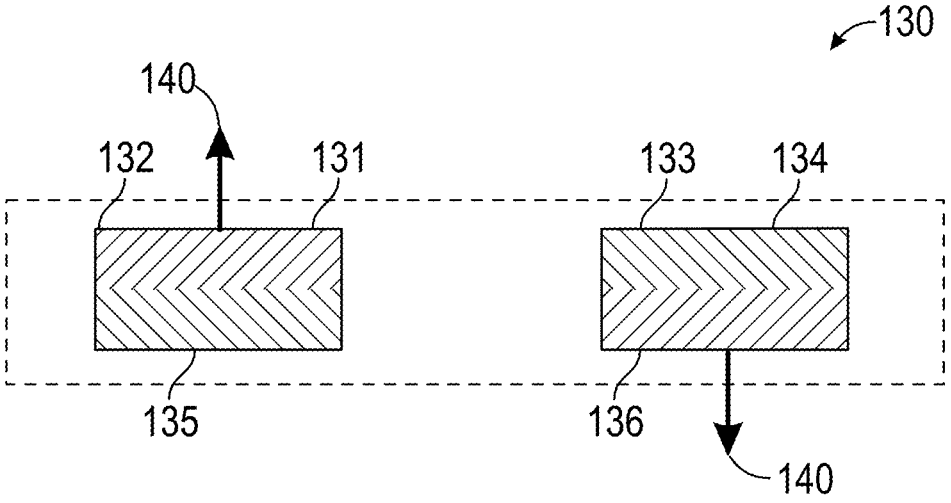
FIG. 7A shows a front view of a magnet group according to an illustrated embodiment.

FIG. 7A shows an edge face view of a magnet group (130) having a particular polarity order configuration. The magnet group as shown comprises a pair of magnets including a first magnet (131) positioned as a leftmost magnet (135) and a second magnet (133) positioned as a rightmost magnet (136). The first magnet is characterized as a single magnet having a first polarity order (132) with a polar direction (140) directed in an upward direction. The second magnet is also characterized as a single magnet having a second polarity order (134) which is opposite the first polarity order such that a polar direction of the second magnet points downwards. FIG. 7A is illustrative of interior magnets when viewed from a card edge face view, or of single edge magnets when viewed from the edge face view.

Figure 7B:
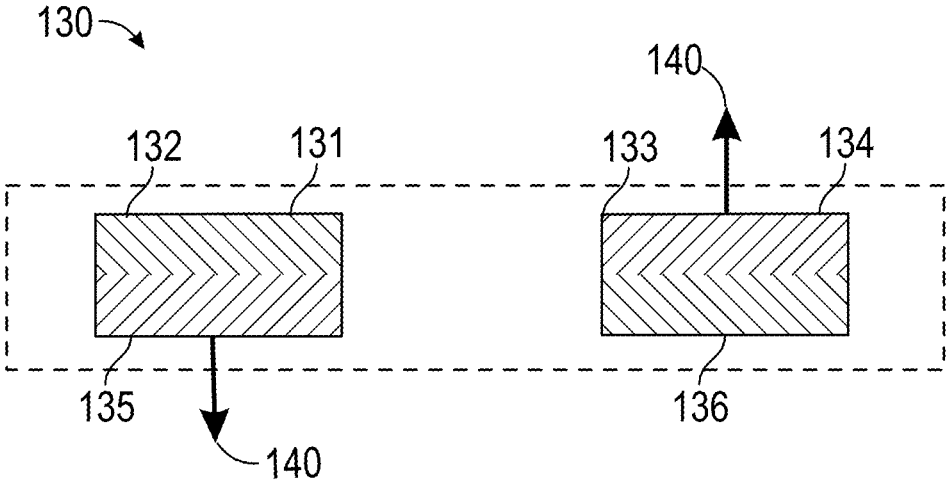
FIG. 7B shows a front view of the magnet group having an alternative polarity order according to an illustrated embodiment.

An alternative configuration of the magnet group (130) is shown in FIG. 7B, wherein the polarity order is reversed between the first magnet (131) and the second magnet (133). To achieve universal magnetic coupling between edge magnet groups and interior magnet groups, the leftmost magnet (135) of each of the edge magnet groups should comprise a same polarity order and the rightmost magnet (136) of each of the edge magnet groups should comprise a same polarity order such that each edge magnet group comprises an alternating polarity order. Furthermore, the leftmost magnet of each of the interior magnet groups should comprise a same polarity order and the rightmost magnet of each of the interior magnet groups should comprise a same polarity order such that each interior magnet group comprises an alternating polarity order. In some embodiments, all magnet groups comprise a uniform polarity order.

Figure 8A:
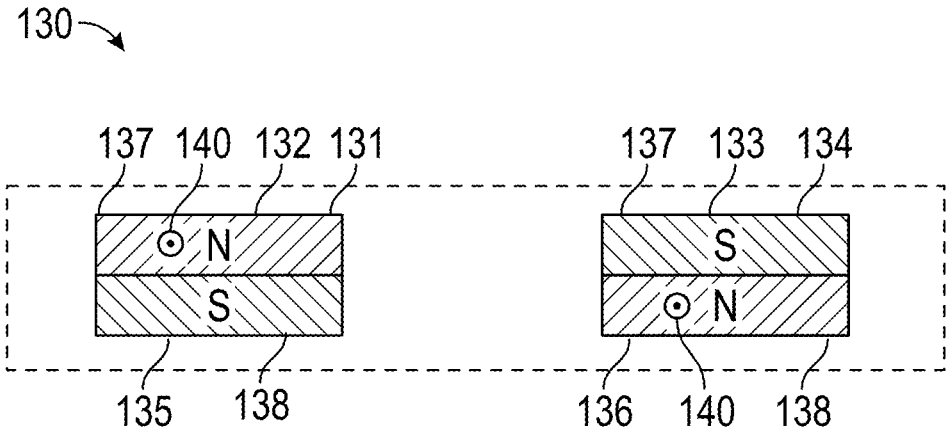
FIG. 8A shows a front view of the magnet group with sub-magnets according to an illustrated embodiment.

FIG. 8A shows a magnet group (130) having a particular polarity order configuration. The magnet group as shown comprises a pair of magnets including a first magnet (131) positioned as a leftmost magnet (135) and a second magnet (133) positioned as a rightmost magnet (136). The first magnet comprises multiple sub-magnets, namely a first sub-magnet (137) and a second sub-magnet (138). The first magnet comprises a first polarity order (132) with a polar direction (140) directed in an outward direction at the first sub-magnet. As illustrated, a north pole of the first sub-magnet and a south pole of the second sub-magnet are both viewable and in coplanar alignment with each other to form the first polarity order. The second magnet comprises multiple sub-magnets, namely a first sub-magnet (137) and a second sub-magnet (138). The second magnet comprises a second polarity order (134) with a polar direction (140) directed outward at the second sub-magnet. A south pole of the first sub-magnet and a north pole of the second sub-magnet are viewable and in coplanar alignment to form the second polarity order (134). The first polarity order is opposite the second polarity order.

Figure 8B:
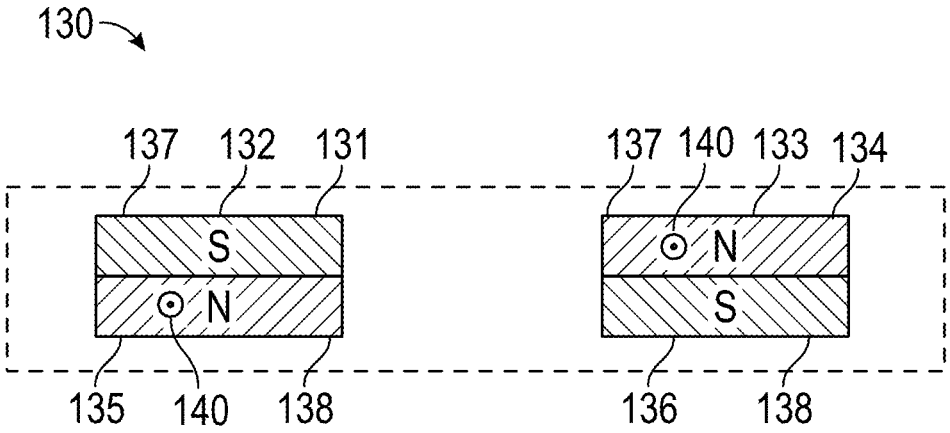
FIG. 8B shows a front view of the magnet group with sub-magnets having an alternative polarity order according to an illustrated embodiment.
Figure 9:
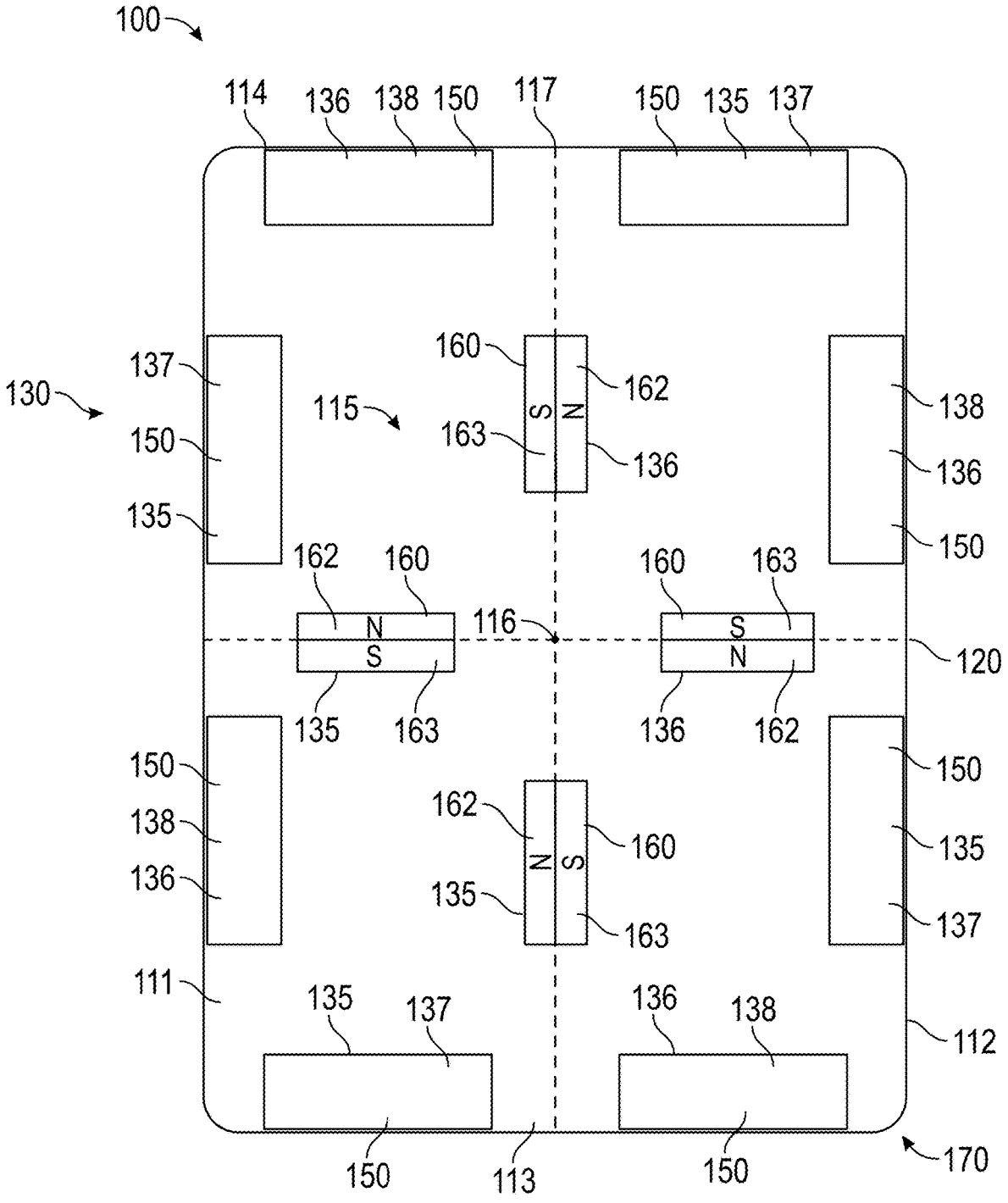
FIG. 9 shows a top view of the substrate with a plurality of magnet groups in accordance with a first illustrated embodiment.
Figure 10:
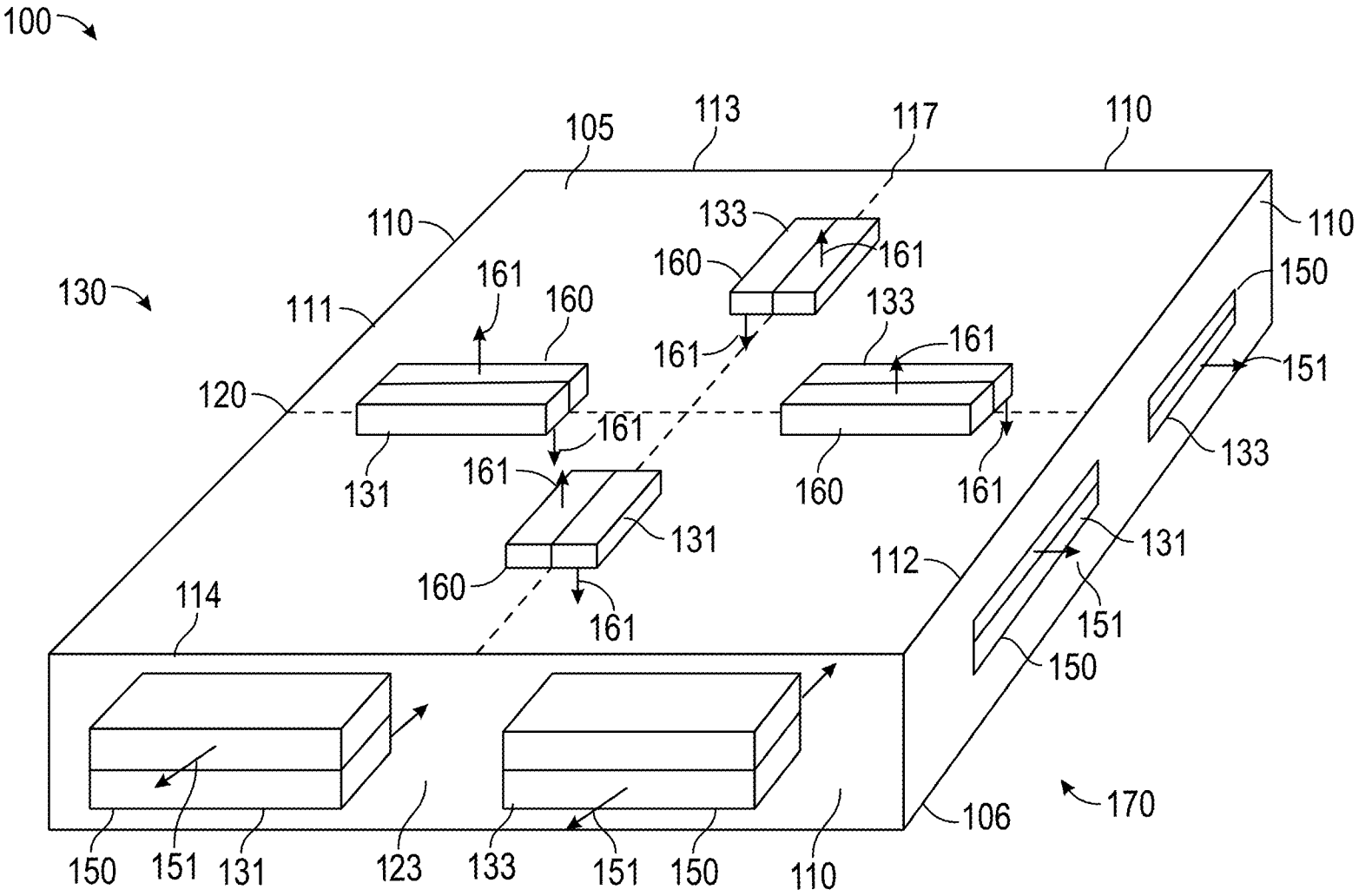
FIG. 10 shows a perspective view of the substrate with the plurality of magnet groups according to the first illustrated embodiment.
Figure 11:
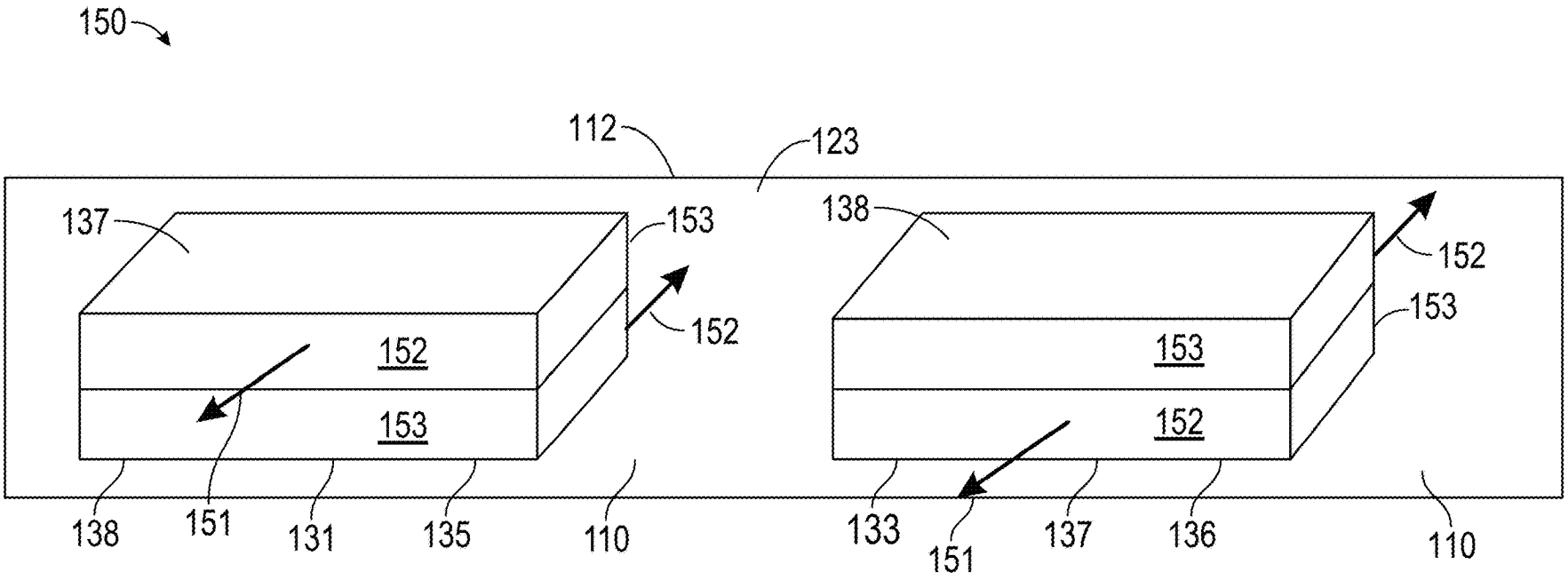
FIG. 11 shows a perspective view of one of a plurality of edge magnet groups according to the first illustrated embodiment.
Figure 12:
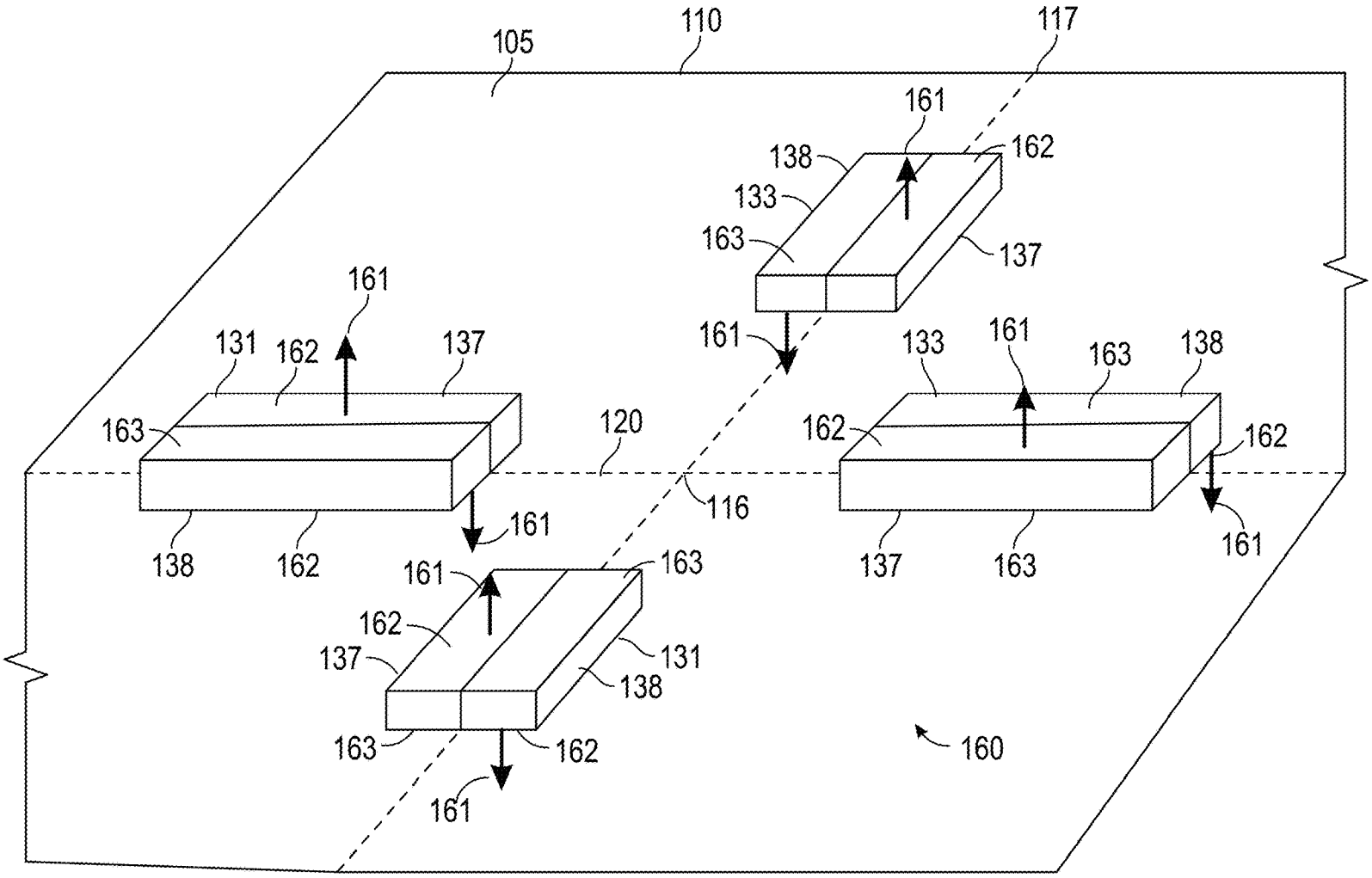
FIG. 12 shows a perspective view of a plurality of interior magnet groups according to the first illustrated embodiment.
Figure 13A:
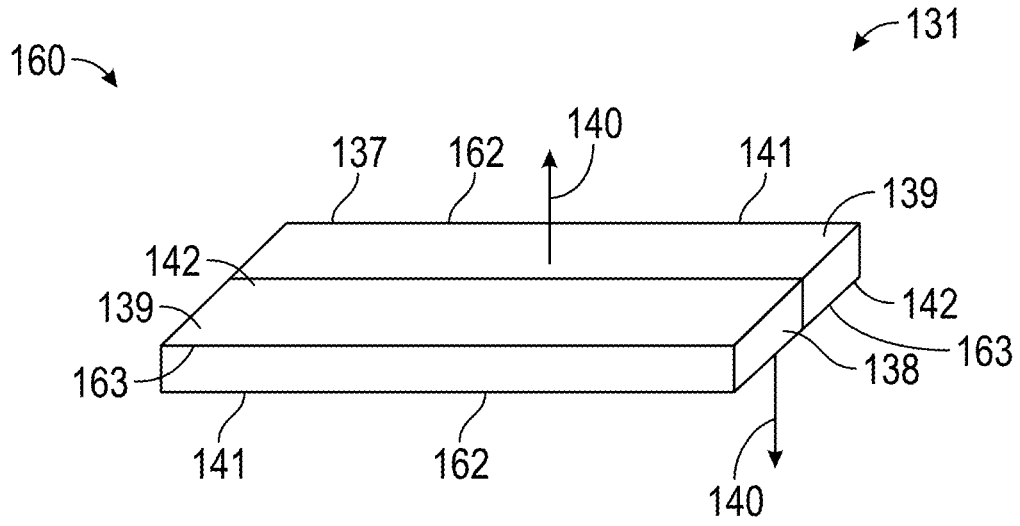
FIG. 13A shows a perspective view of an interior magnet having a planar structure according to the first illustrated embodiment.
Figure 13B:
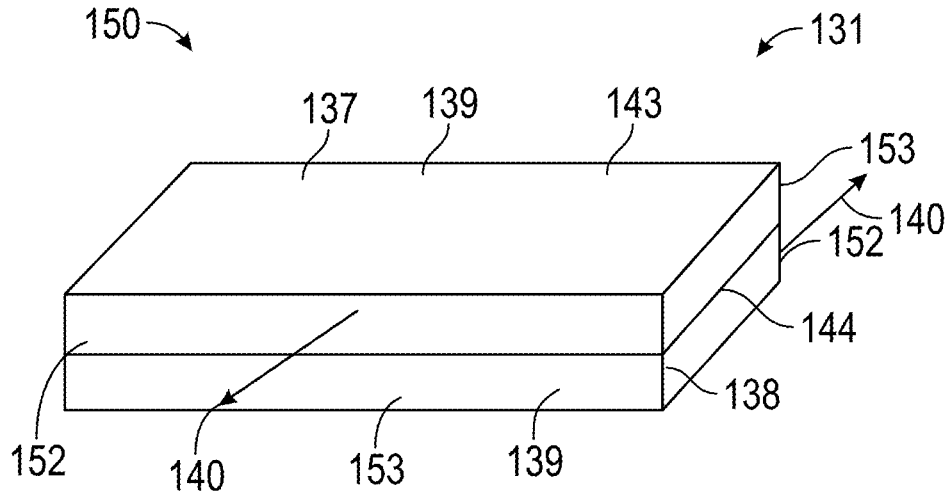
FIG. 13B shows a perspective view of an edge magnet having a planar structure according to the first illustrated embodiment.
Figure 14:
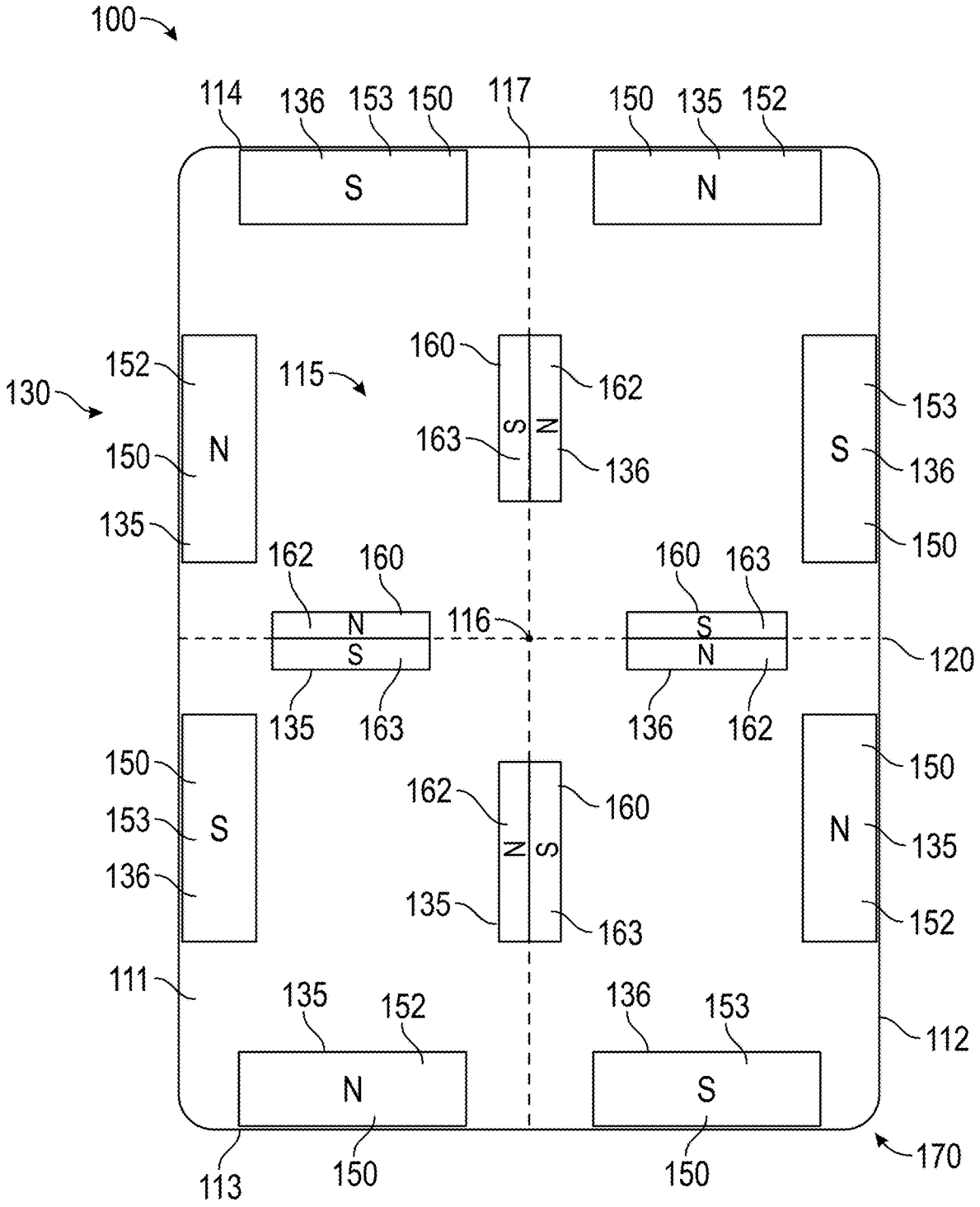
FIG. 14 shows a top view of the substrate with a plurality of magnet groups in accordance with a second illustrated embodiment.
Figure 15:
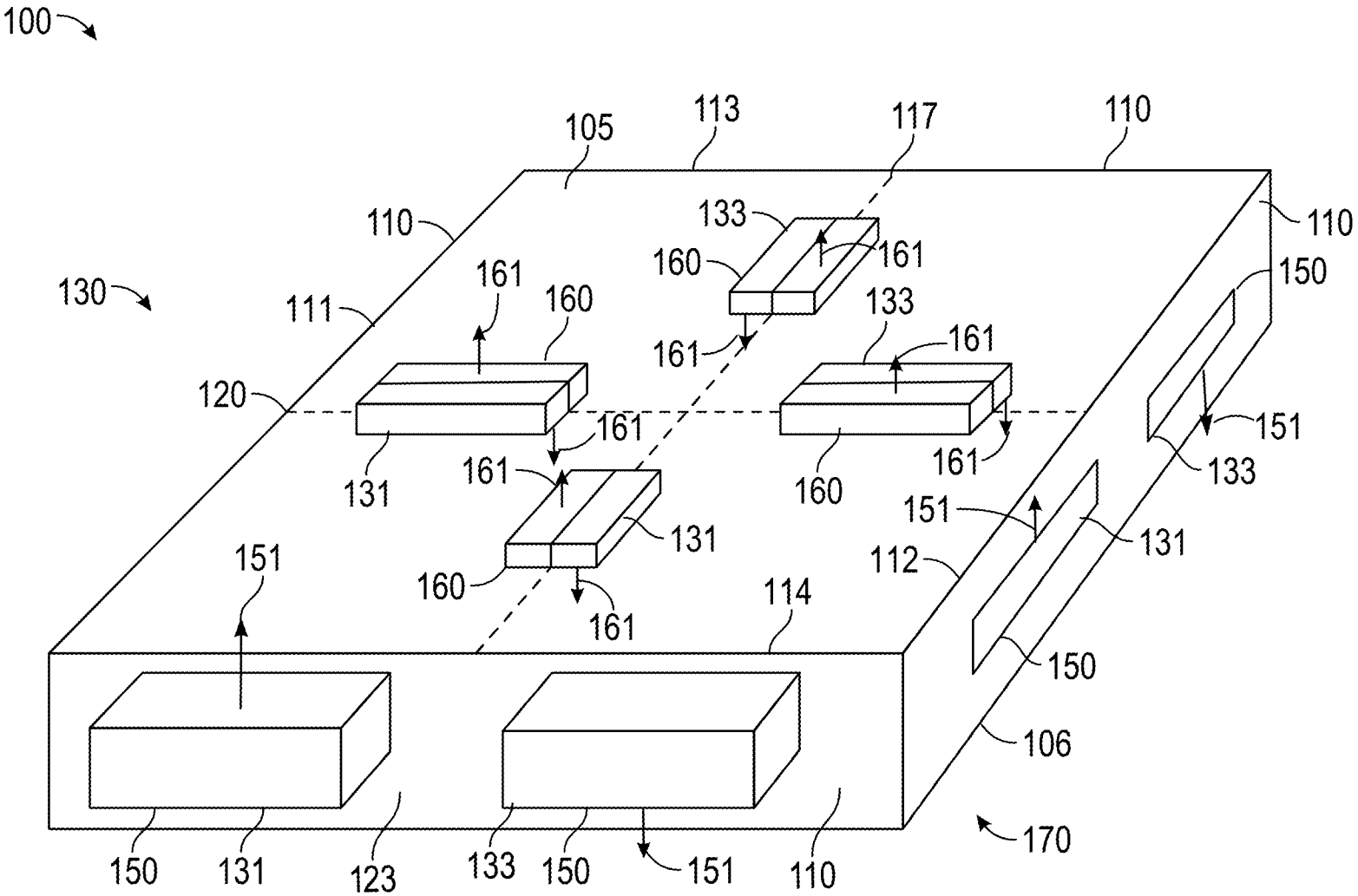
FIG. 15 shows a perspective view of the substrate with the plurality of magnet groups according to the second illustrated embodiment.
Figure 16:
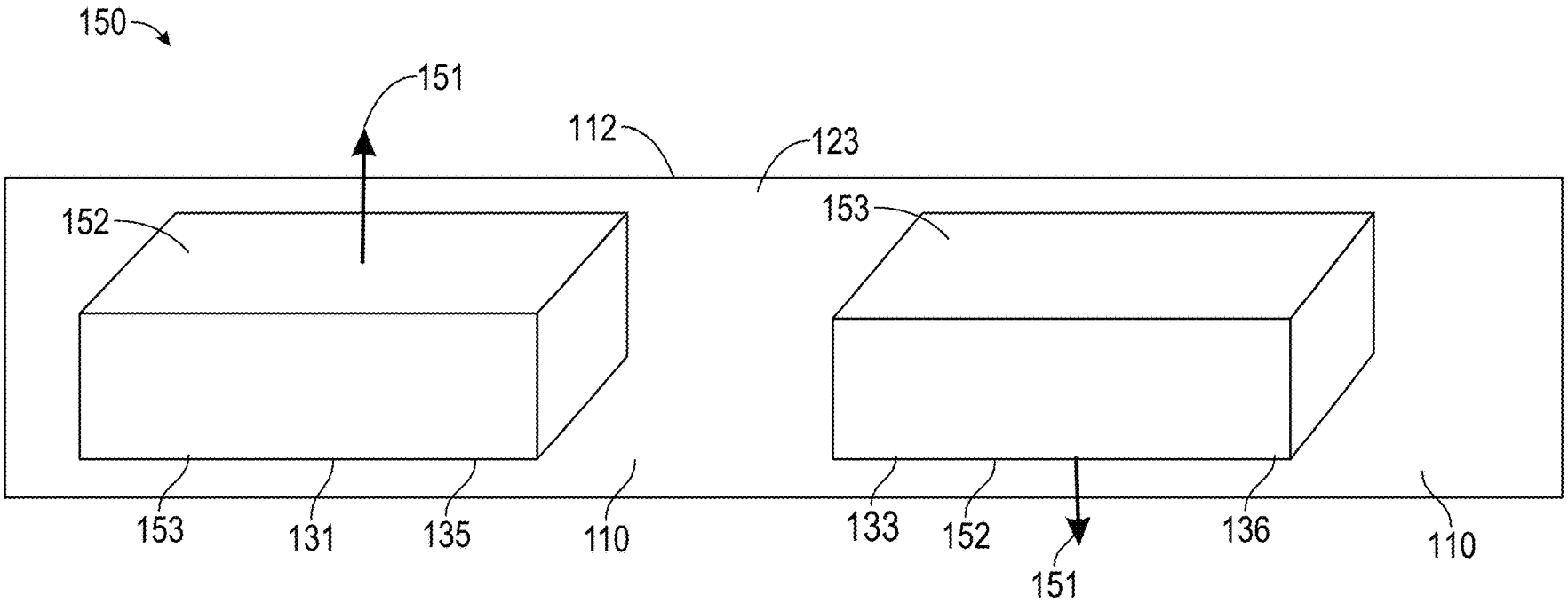
FIG. 16 shows a perspective view of one of a plurality of edge magnet groups according to the second illustrated embodiment.
Figure 17:
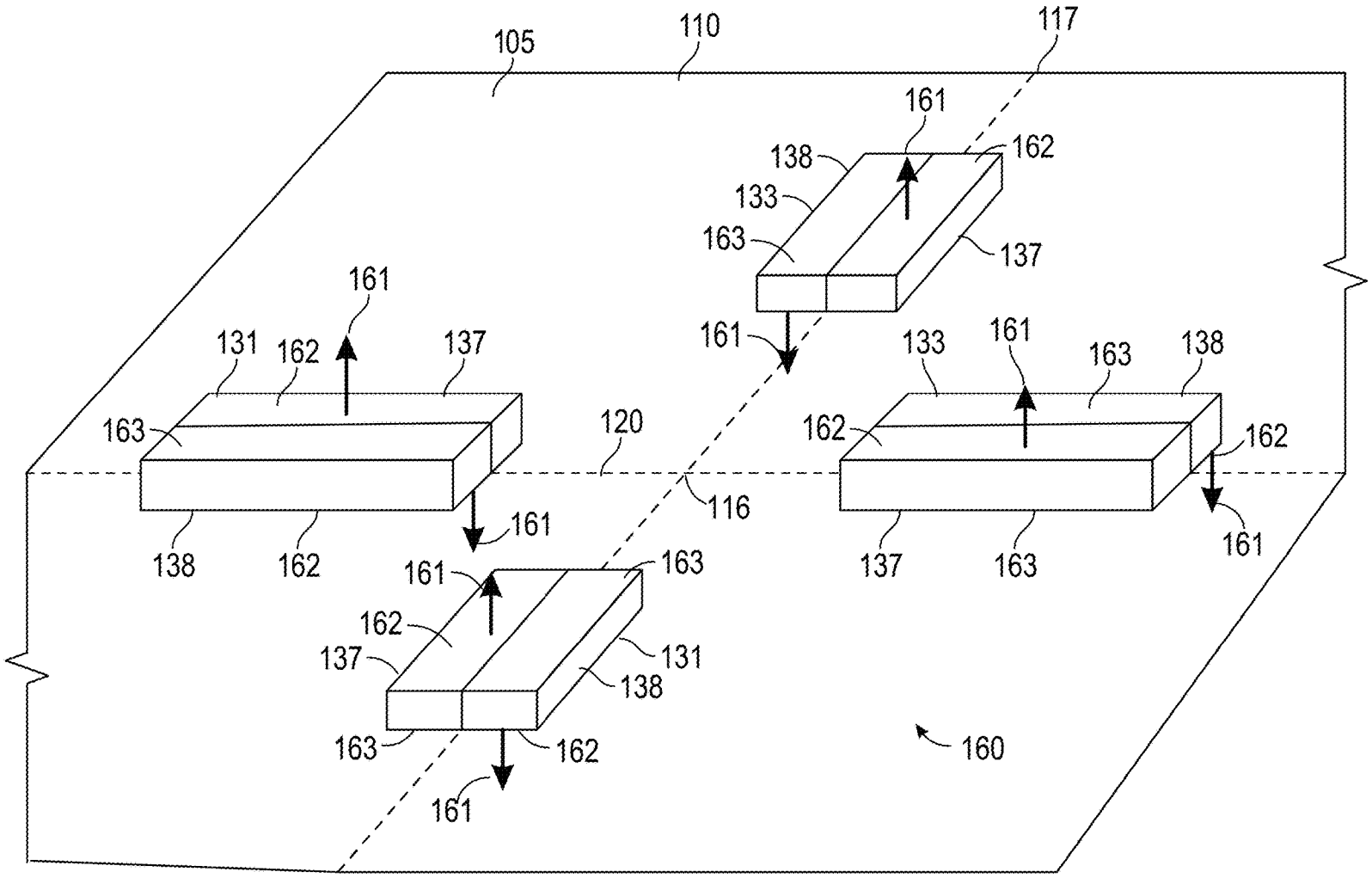
FIG. 17 shows a perspective view of a plurality of interior magnet groups according to the second illustrated embodiment.

An alternative configuration of the magnet group (130) is shown in FIG. 8B, wherein the polarity order is reversed between the first magnet (131) and the second magnet (133). To achieve universal magnetic coupling between edge magnet groups and interior magnet groups, the leftmost magnet (135) of each of the edge magnet groups should comprise a same polarity order and the rightmost magnet (136) of each of the edge magnet groups should comprise a same polarity order such that each edge magnet group comprises an alternating polarity order. Furthermore, the leftmost magnet of each of the interior magnet groups should comprise a same polarity order and the rightmost magnet of each of the interior magnet groups should comprise a same polarity order such that each interior magnet group comprises an alternating polarity order. In some embodiments, all magnet groups comprise a uniform polarity order.

FIGS. 9-13B shows a substrate (100) with a plurality of magnet groups (130) in accordance with a first illustrated embodiment. The substrate comprises a top surface (105), a bottom surface (106), and a substrate interior (115) surrounded by a plurality of edges (110). The plurality of edges comprises a first major side (111), a second major side (112) opposite the first major side, a first minor side (113), and a second minor side (114) opposite the first minor side. A longitudinal centerline (117) extends from the first minor side to the second minor side. A lateral centerline (120) extends from the first major side to the second major side.

The plurality of magnet groups (130) further comprises a plurality of edge magnet groups (150) disposed at the plurality of edges (110) and a plurality of interior magnet groups (160) disposed within the substrate interior (115). Each edge magnet group of the plurality of edge magnet groups comprises a first magnet (131) being a leftmost magnet (135) and a second magnet (133) being a rightmost magnet (136) when viewed from a side view of a nearest edge (123) of the substrate (100). The first magnet and the second magnet each comprise a first sub-magnet (137) and a second sub-magnet (138) wherein an edge polar direction (151) for both the first magnet and the second magnet extends orthogonally from the nearest edge and parallel with the top surface (105) of the substrate. The first magnet as viewed from the nearest edge comprises an edge north pole (152) of the first sub-magnet disposed above an edge south pole (153) of the second sub-magnet. The second magnet as viewed from the nearest edge comprises the edge south pole of the second sub-magnet disposed above the edge north pole of the first sub-magnet. Because the leftmost magnet of each edge magnet group is in a same polarity order, the rightmost magnet of each edge magnet group is in a same polarity order, and each edge magnet group comprises an alternating polarity order, the plurality of edge magnet groups is characterized as being in uniform polarity alignment (170) to achieve universal magnetic coupling regardless of orientation of the substrate.

The plurality of interior magnet groups (160) comprises one interior magnet group disposed on the longitudinal centerline (117) at the substrate interior (115), and one interior magnet group disposed on the lateral centerline (120) at the substrate interior. Each interior magnet group of the plurality of interior magnet groups comprises a first magnet (131) being a leftmost magnet (135) and a second magnet (133) being a rightmost magnet (136) when viewed from a top view over the top surface (105) of the substrate (100). The first magnet and the second magnet each comprise a first sub-magnet (137) and a second sub-magnet (138) wherein an interior polar direction (161) for both the first magnet and the second magnet extends orthogonally from the top surface and parallel with each of the plurality of edges (110). The first magnet as viewed from the top surface comprises an interior north pole (162) of the first sub-magnet disposed above an interior south pole (163) of the second sub-magnet. Alternatively, the second magnet as viewed from the top surface comprises the interior south pole of the second sub-magnet disposed above the interior north pole of the first sub-magnet. Because the leftmost magnet of each interior magnet group is in a same polarity order, the rightmost magnet of each interior magnet group is in a same polarity order, and each interior magnet group comprises an alternating polarity order, the plurality of interior magnet groups is characterized as being in uniform polarity alignment (170) to achieve universal magnetic coupling regardless of orientation of the substrate. Furthermore, the plurality of interior magnet groups and the plurality of edge magnet groups can altogether be characterized as being in the uniform polarity alignment.

Each interior magnet of the plurality of interior magnet groups (160) comprises a planar structure (139) to reduce thickness of the substrate (100). The planar structure of each interior sub-magnet comprises a first interior face (141) and a second interior face (142) opposite the first interior face. Each interior magnet comprises a polar direction (140) of the first sub-magnet (137) and a polar direction of the second sub-magnet (138), each extending orthogonally to both the first interior face and the second interior face. Likewise, each edge magnet of the plurality of edge magnet groups (150) comprises a planar structure (139) to reduce thickness of the substrate. The planar structure of each edge sub-magnet comprises a first edge face (143) and a second edge face (144) opposite the first edge face. Each edge magnet comprises a polar direction (140) of the first sub-magnet and a polar direction of the second sub-magnet, each extending parallel to both the first edge face and the second edge face.

FIGS. 14-17 shows the substrate (100) with the plurality of magnet groups (130) in accordance with a second illustrated embodiment. The substrate comprises a top surface (105), a bottom surface (106), and a substrate interior (115) surrounded by a plurality of edges (110). The plurality of edges comprises a first major side (111), a second major side (112) opposite the first major side, a first minor side (113), and a second minor side (114) opposite the first minor side. A longitudinal centerline (117) extends from the first minor side to the second minor side. A lateral centerline (120) extends from the first major side to the second major side.

The plurality of magnet groups (130) further comprises a plurality of edge magnet groups (150) disposed at the plurality of edges (110) and a plurality of interior magnet groups (160) disposed within the substrate interior (115). Each edge magnet group of the plurality of edge magnet groups comprises a first magnet (131) being a leftmost magnet (135) and a second magnet (133) being a rightmost magnet (136) when viewed from a side view of a nearest edge (123) of the substrate. The first magnet and the second magnet each comprise a single magnet wherein an edge polar direction (151) for both the first magnet and the second magnet extends orthogonally from the top surface (105) and parallel with the nearest edge. The first magnet as viewed from the nearest edge comprises an edge north pole (152) extending through the top surface of the substrate. The second magnet as viewed from the nearest edge comprises the edge north pole extending through the bottom surface (106) of the substrate. Because the leftmost magnet of each edge magnet group is in a same polarity order, the rightmost magnet of each edge magnet group is in a same polarity order, and each edge magnet group comprises an alternating polarity order, the plurality of edge magnet groups is characterized as being in uniform polarity alignment (170) to achieve universal magnetic coupling regardless of orientation of the substrate.

The plurality of interior magnet groups (160) comprises one interior magnet group disposed on the longitudinal centerline (117) at the substrate interior (115), and one interior magnet group disposed on the lateral centerline (120) at the substrate interior. Each interior magnet group of the plurality of interior magnet groups comprises a first magnet (131) being a leftmost magnet (135) and a second magnet (133) being a rightmost magnet (136) when viewed from a top view over the top surface (105) of the substrate (100). The first magnet and the second magnet each comprise a first sub-magnet (137) and a second sub-magnet (138) wherein an interior polar direction (161) for both the first magnet and the second magnet extends orthogonally from the top surface and parallel with each of the plurality of edges (110). The first magnet as viewed from the top surface comprises an interior north pole (162) of the first sub-magnet disposed above an interior south pole (163) of the second sub-magnet. Alternatively, the second magnet as viewed from the top surface comprises the interior south pole of the second sub-magnet disposed above the interior north pole of the first sub-magnet. Because the leftmost magnet of each interior magnet group is in a same polarity order, the rightmost magnet of each interior magnet group is in a same polarity order, and each interior magnet group comprises an alternating polarity order, the plurality of interior magnet groups is characterized as being in uniform polarity alignment (170) to achieve universal magnetic coupling regardless of orientation of the substrate.

Feature List substrate (100)
plurality of apertures (101)
top flat plate (102)
rounded corners (103)
bottom flat plate (104)
top surface (105)
bottom surface (106)
plurality of edges (110)
first major side (111)
second major side (112)
first minor side (113)
second minor side (114)
substrate interior (115)
center (116)
longitudinal centerline (117)
first longitudinal half (118)
second longitudinal half (119)
lateral centerline (120)
first lateral half (121)
second lateral half (122)
nearest edge (123)
plurality of magnet groups (130)
first magnet (131)
first polarity order (132)
second magnet (133)
second polarity order (134)
leftmost magnet (135)
rightmost magnet (136)
first sub-magnet (137)
second sub-magnet (138)
planar structure (139)
polar direction (140)

first interior face (141)
second interior face (142)
first edge face (143)
second edge face (144)
plurality of edge magnet groups (150)
edge polar direction (151)
edge north pole (152)
edge south pole (153)
plurality of interior magnet groups (160)
interior polar direction (161)
interior north pole (162)
interior south pole (163)
uniform polarity alignment (170)
magnetic playing card (200)
front side (201)
playing card front face (202)
back side (203)
playing card back face (204)
secondary magnetic playing card (205)

What is claimed is:

1. A magnetic playing card configured to magnetically couple to a second magnetic playing card having a plurality of edge magnet groups and a plurality of interior magnet groups, comprising:

a front side including a playing-card front face;

a back side including a playing-card back face;

a substrate disposed between the front side and the back side, the substrate having a top surface, a bottom surface opposite the top surface, and four edges coupled to the top and bottom surfaces, the four edges comprising a first major side, a second major side opposite the first major side, a first minor side, and a second minor side opposite the first minor side, the four edges surrounding a substrate interior comprising a center;

a plurality of apertures formed through the substrate; and a plurality of magnet groups disposed within the plurality of apertures, the plurality of magnet groups comprising:

(i) four edge magnet groups with one edge magnet group disposed at each of the four edges; and (ii) at least two interior magnet groups disposed at the substrate interior, including a first interior magnet group disposed on a longitudinal centerline extending between the first minor side and the second minor side and a second interior magnet group disposed on a lateral centerline extending between the first major side and the second major side;

wherein each magnet group is defined by a pair of apertures comprising a first aperture and a second aperture arranged side-by-side;

wherein each of the pair of apertures contains a composite magnet fixed within the respective aperture, each composite magnet comprising a first sub-magnet and a second sub-magnet fixed together, the first sub-magnet having a polar direction opposite a polar direction of the second sub-magnet;

wherein, for each of the four edge magnet groups:

(a) in the composite magnet in the first aperture, an edge north pole of the first sub-magnet and an edge south pole of the second sub-magnet both face toward the nearest edge, the edge north pole being closer to the top surface than the edge south pole; and (b) in the composite magnet in the second aperture, an edge south pole of the first sub-magnet and an edge north pole of the second sub-magnet both face toward the nearest edge, the edge south pole being closer to the top surface than the edge north pole; and wherein, for each of the at least two interior magnet groups:

(a) in the composite magnet in the first aperture, an interior north pole of the first sub-magnet and an interior south pole of the second sub-magnet both face toward the top surface; and (b) in the composite magnet in the second aperture, an interior south pole of the first sub-magnet and an interior north pole of the second sub-magnet both face toward the top surface;

whereby any edge magnet group or any interior magnet group of the magnetic playing card is configured to magnetically couple to any edge magnet group or any interior magnet group of the second magnetic playing card, in either face-up orientation.

2. The magnetic playing card of claim 1, wherein each of the first sub-magnet and the second sub-magnet comprises a planar structure having a thickness that is less than a length and a width of the planar structure.

3. The magnetic playing card of claim 1, wherein, for each interior magnet group, the polar directions of the first sub-magnet and the second sub-magnet extend orthogonally to the top surface, and wherein, for each edge magnet group, the polar directions of the first sub-magnet and the second sub-magnet extend orthogonally from the nearest edge and parallel to the top surface.

4. The magnetic playing card of claim 1, wherein the longitudinal centerline and the lateral centerline intersect at the center of the substrate and are perpendicular to each other.

5. The magnetic playing card of claim 1, further comprising a top flat plate coupled to the top surface and a bottom flat plate coupled to the bottom surface such that the plurality of magnet groups is encapsulated between the top flat plate and the bottom flat plate.

6. The magnetic playing card of claim 1, wherein the first major side and the second major side each have a length of about 3.5 inches and the first minor side and the second minor side each have a length of about 2.5 inches.

7. The magnetic playing card of claim 1, wherein the substrate includes rounded corners.

8. The magnetic playing card of claim 1, wherein the plurality of edge magnet groups and the plurality of interior magnet groups are in uniform polarity alignment.

* * * * *